United States Patent [19]

Baboian

[11] 4,209,896

[45] Jul. 1, 1980

[54] METHOD OF ASSEMBLY OF AN ANTI-CORROSION ANODE CONNECTOR SYSTEM

[75] Inventor: Robert Baboian, Johnston, R.I.

[73] Assignee: Texas Instruments Incorporated, Dallas, Tex.

[21] Appl. No.: 879,040

[22] Filed: Feb. 21, 1978

Related U.S. Application Data

[62] Division of Ser. No. 673,177, Apr. 2, 1976, Pat. No. 4,098,663.

[51] Int. Cl.[2] ..... H01R 43/00; C23F-13/00

[52] U.S. Cl. ..... 29/855; 29/592 R; 29/447

[58] Field of Search ..... 29/628, 624, 592, 623.2, 29/623.1, 447; 174/76, 77 R; 204/196, 197, 147, 148, 286, 297 R

[56] References Cited

U.S. PATENT DOCUMENTS

| | | | |
|---|---|---|---|
| 2,999,800 | 9/1961 | Reeside | 29/628 |
| 3,038,849 | 6/1962 | Preiser | 204/196 |
| 3,043,765 | 7/1962 | Bryan et al. | 204/196 |
| 3,133,873 | 5/1964 | Miller et al. | 204/196 |
| 3,380,908 | 4/1968 | Ono et al. | 204/290 F |
| 3,488,274 | 1/1970 | Geld | 204/196 |
| 3,559,274 | 2/1971 | Granata | 29/447 |
| 3,652,758 | 3/1972 | De Saint Pierre | 29/629 |

FOREIGN PATENT DOCUMENTS

| | | | |
|---|---|---|---|
| 3022 | of 1904 | United Kingdom | 29/628 |

*Primary Examiner*—Daniel C. Crane
*Attorney, Agent, or Firm*—John A. Haug; James P. McAndrews

[57] ABSTRACT

An anode connector for use in an impressed current cathodic protection system comprising a cup-shaped housing member made from a material which is permanent under anodic conditions with a plug insert member with a central aperture made from conventional current carrying metals which is press fit into the cup-shaped housing. The cup-shaped housing can then be welded to an anode. A cable conductor for the anode which is well insulated except for the end is positioned with the uninsulated end in the central aperture of the plug insert and soldered thereto to provide excellent electrical conductivity between the cable and the plug. The cup is then filled with suitable insulating potting material which covers the plug and the cable conductor to a height above where the insulation begins. This invention provides a rigid, reliable anode connector which is able to withstand anodic conditions in an impressed current cathodic protection system while still providing the current to the anode.

3 Claims, 3 Drawing Figures

METHOD OF ASSEMBLY OF AN ANTI-CORROSION ANODE CONNECTOR SYSTEM

This is a division, of application Ser. No. 673,177, filed Apr. 2, 1976 which issued on July 4, 1978 as U.S. Pat. No. 4,098,663.

BACKGROUND AND SUMMARY OF INVENTION

This invention relates to an anode connector and more particularly an anode connector for an anode that is permanent under anodic conditions of impressed current systems.

In an impressed current cathodic protection system with an anode which is made from materials that are permanent under anodic conditions, the connection between the cable conductor and anode must be rigid and durable under extremely corrosive conditions while still being capable of carrying substantial current over long distances. In order to provide for the needed current carrying characteristics, materials such as copper or aluminum are required for the cable conductor. However, these materials suffer extremely rapid corrosion when in use under the anodic conditions of impressed current systems and therefore must be extremely well insulated to allow their use.

Prior art systems have used a direct connection between the cable conductor and the anode which is then completely surrounded by an insulating cold setting compound. These systems have been successful for short duration applications but may exhibit leakage problems in long life applications especially in the presense of heavy gassing of chlorine and oxygen. Additionally prior art systems have also lacked a connection which can withstand high impact and tensile forces.

Accordingly, it is an object of the present invention to provide an improved anode connector.

It is another object of this invention to provide an anode connector with high strength and a low resistivity connection.

It is still another object of this invention to provide an anode connector which is simple in design and easily assembled.

It is yet another object of this invention to provide an anode connector which can protect against the variety of forces encountered in service and provide a leak-free seal. Other objects and features of this invention will be in part apparent and in part pointed out hereinafter.

Briefly, the anode connector of this invention comprises a cup-shaped housing member of an inert material into which a plug insert member with a central aperture made from conventional current carrying material is press fit. The plug insert member fits down into the cup-shaped housing so that the side wall of the cup extends above the plug. The cup can now be welded directly to the anode or attached by a inert strap welded to both the outside of the housing and the anode. A cable conductor which is well insulated except for one end where the insulation is removed is positioned to extend into the cup-shaped housing with the uninsulated end in the central aperture of the plug. The uninsulated end is then soldered to the plug insert member providing a low resistance, strong connection. Next the solder connection and the remaining unfilled portion of the cup is surrounded and filled with a suitable insulating potting material making sure to cover the cable conductor to a height above where the insulation begins.

The anode connector provides a simple reliable method for making connection to the inert anode. The method of assembly is simple while providing for a high strength, low resistivity connection. The cup-shaped housing protects the insulating potting material from tensile and impact forces and from heavy gassing of chlorine and oxygen. Also the connector can be used with different size and shaped inert anodes equally well to provide flexibility in design.

DESCRIPTION OF DRAWINGS

Corresponding reference characters indicate corresponding parts throughout the several views of the drawings.

DESCRIPTION OF THE PREFERRED EMBODIMENTS

Figure 1:
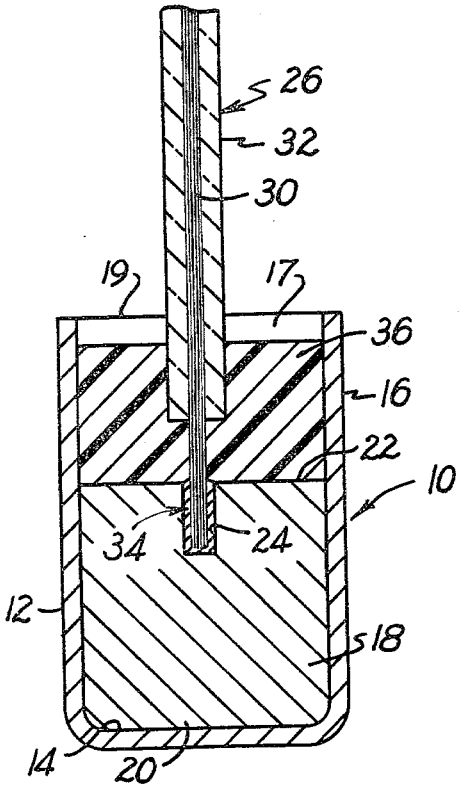
FIG. 1 is a cross-sectional view of an anode connector of this invention with a cable conductor connected thereto.

Referring to the drawings, 10 in FIG. 1 shows an anode connector of this invention. The connector 10 includes a cup-shaped housing member 12 having a closed flat circular bottom porton 14 with an upstanding side wall 16 extending around the perimeter of the bottom portion leading to an open portion 17 with a rim 19 around it. Housing member 12 is preferably made from a virtually chemically inert metal such as tantalum or columbium although titanium may be used. The cup-shaped housing may be made by conventional spinning or deep drawing methods. Typically the cup will be 2-½ inches high and ¾ of an inch in diameter with a wall thickness of 0.025 of an inch.

Figure 2:
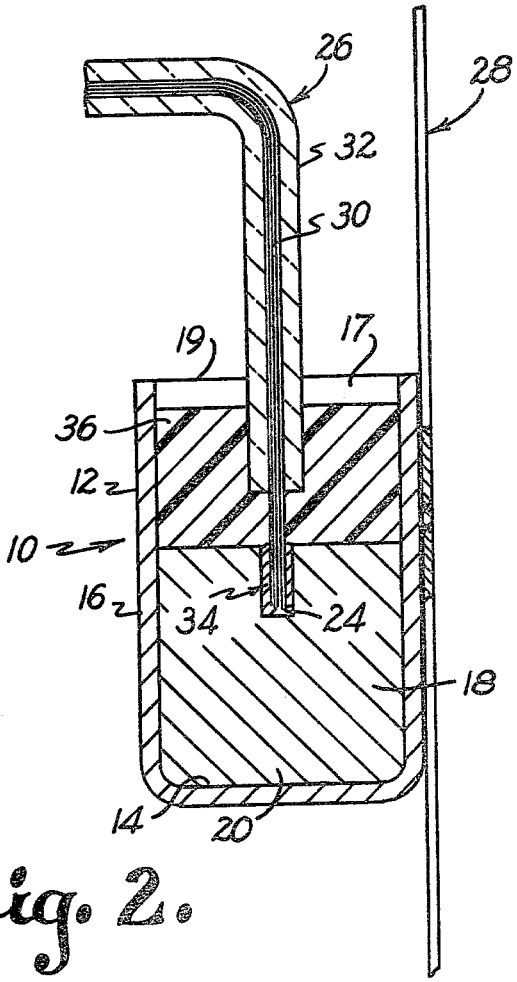
FIG. 2 is similar to FIG. 1 with the anode connector directly welded to an anode.

An electrically conductive insert plug member 18 is press fit into cup-shaped housing 12. Preferably insert plug member 18 is made from copper or aluminum. The plug member is preferably positioned in housing 12 to have a first end 20 in contact with bottom portion 14 and to have a second end 22 facing the open end of the cup but substantially below the open end of the side wall 16. The member 18 may be cooled in liquid nitrogen or the like prior to inserting it in the housing to cause it to contract to ensure a snug fit in the housing. A central aperture 24 is provided in plug member 18 and extends into the member from second end 22 adjacent the open end of the cup as shown in FIGS. 1 and 2. Typically the aperture extends into the plug member approximately one-third of the plug thickness although it may extend completely therethrough.

Accordingly a cable conductor 26 for supplying current to an anode 28 as seen in FIG. 2 is provided to connect to plug member 18. Cable conductor 26 is made with a conventional electrical metal core material 30 such as copper or aluminium surrounded by an insulating material 32 such as a plastic or synthetic rubbers. An example of a suitable insulating material would be polyvinyl chloride. Insulating material 32 is removed from one to expose electrical metal 30 so it can be inserted in aperture 24 of plug member 18 and welded or soldered thereto by conventional means to provide a low reistance, high strength connection 34.

Accordingly electrical connection 34 is surrounded and the remainder of cup-shaped housing 12 filled with a suitable insulating material 36 such as epoxy, plastic or the like to provide a tight, leak proof seal. It is important that insulating material 36 is cup-shaped housing 12 surrounds and seals cable conductor 26 above where the insulated portion of the cable 26 begins so that the electrical metal 30 of the cable is not exposed to the environment.

Figure 3:
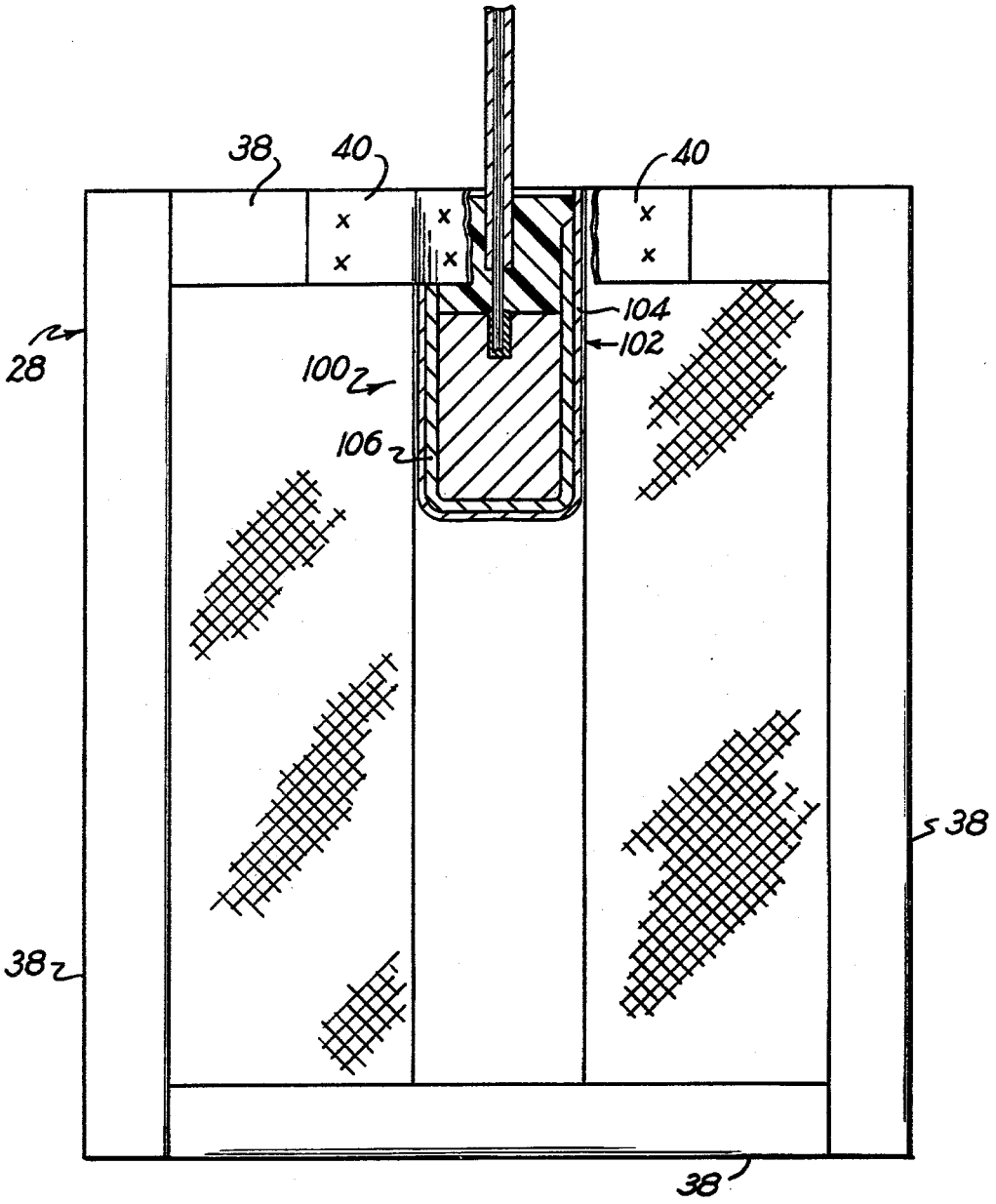
FIG. 3 is a cross-sectional view of a second embodiment of the anode connector of this invention with a cable conductor connected thereto and a welding strap member securing the connector to an anode.

As shown by FIG. 2 anode connector 10 is attached to anode 28. The anode is preferably a platinum-clad columbium or tantalum anode with support members 38 around the perimeter of the anode of either columbium or tantalum. The connector can be directly welded to the anode as shown by FIG. 2 preferably prior to attaching the cable conductor or welded with a strap member 40 as shown in FIG. 3 either prior to attaching the cable connector and potting with insulating material or after finish assembly of the connector. Typically the strap is made from the same material as cup-shaped housing 10 and spot welded to the metal support member of the anode at the top as shown in FIG. 3 although it could be welded at other locations equally well.

In use in a cathodic protection system, the connector provides current to the anode from a power supply through a conductor cable. Since the conductor cable and connecor are at the same potential as the anode and exposed to an elecrolyte while in use, extremely rapid corrosion will occur to them unless they are virtually chemically inert. The present connector of this invention provides a system which is totally resistant to the chemical attack. The electrolyte only comes into contact with the conductor cable insulation, the potting epoxy and the cup-shaped housing which are all made from chemically inert materials. The cup-shaped housing further provides rigidity and strength to the system to prevent leaks from occurring with time. The potting epoxy is protected inside of the cup-shaped housing from impact forces so the seal does not break down around the electrical connection. Additionally the cup protects the potting material from the gassing of chlorine or oxygen which can occur.

The connector can be connected to anodes of varying sizes and shapes allowing for flexibility in design. Also more than one connector can be attached to the same anode if a large supply of current is needed. Additionally the connection between the connector and anode can be made virtually anywhere on the anode. By preassembling plug member in the cup-shaped housing and joining to an anode, field installation can be easily done only requiring a portable torch for soldering the connection and subsequent encapsulation of the cavity in the cup with insulating potting epoxy.

In FIG. 3 at numeral 100 a second embodiment of the anode connector of this invention is shown. A cup-shaped member 102 is made from a clad material having an outside layer 104 made from a chemically inert material such as columbium and tantalum and having an inside layer 106 made from an elecrical material similar to the material used in plug member of the first embodiment such as copper or aluminum. The inside layer is removed adjacent the open end of the cup by machining or the like to ensure the electrolyte does not come into contact with this electrical material. In all other respects of structure and assembly, anode connector 100 of the second embodiment is similar to anode connector 10 of FIGS. 1 and 2. The multi-layer housing provide excellent electrical properties while using less of the more expensive chemically inert housing material.

In view of the above, it will be seen that the several objects of the invention are achieved and other advantageous results attained.

As various changes could be made in the above construction without departing from the scope of the invention, it is intended that all matter contained in the above description and shown in the accompanying drawings shall be interpreted as illustrative and not in a limiting sense.

I claim:

1. A method of assembling an anode connector for connecting a current carrying conductor cable to a permanent anode comprising:

providing a ductile, chemically inert metal;

forming the metal into a cup-shaped housing member having a closed end formed by a bottom wall and having a side wall depending therefrom, the side wall having a free end portion forming an open end, the bottom and side wall having a thickness which is essentially uniform throughout;

inserting an electrically conductive plug member in said housing having one end adjacent said closed end and having a second end facing toward said open end while being substantially removed from the open end;

electrically connecting said conductor cable to said plug member to provide a low resistance connection;

inserting a chemically insulating material in said housing for surrounding said electrical connection and filling said cup-shaped housing to provide a tight, leak-proof seal;

attaching said anode connector to an anode.

2. A method of assembling an anode connector as set forth in claim 1 further including cooling said plug member in liquid nitrogen to cause said plug to contract to ensure a snug fit in the housing.

3. A method of assembling an anode connector as set forth in claim 2 further including providing a chemically inert strap member for joining said connector to said anode.

* * * * *